US005720649A

United States Patent [19]

Gerber et al.

[11] Patent Number: 5,720,649

[45] Date of Patent: Feb. 24, 1998

[54] OPTICAL LENS OR LAP BLANK SURFACING MACHINE, RELATED METHOD AND CUTTING TOOL FOR USE THEREWITH

[75] Inventors: Heinz Joseph Gerber, West Hartford; Kenneth O. Wood, Stafford Springs; Jeffrey J. Murray, Ellington, all of Conn.; David J. Logan, Great Barrington, Mass.

[73] Assignee: Gerber Optical, Inc., South Windsor, Conn.

[21] Appl. No.: 577,230

[22] Filed: Dec. 22, 1995

[51] Int. Cl.[6] ..... B24B 1/00; B24B 7/19; B24B 7/30

[52] U.S. Cl. ..... 451/41; 451/42

[58] Field of Search ..... 451/41, 42, 43, 451/461, 544

[56] References Cited

U.S. PATENT DOCUMENTS

| | | | |
|---|---|---|---|
| 1,072,620 | 9/1913 | Klay | 451/461 |
| 3,117,396 | 1/1964 | Dalton | 451/42 |
| 3,218,765 | 11/1965 | Volk | 451/42 |
| 3,798,844 | 3/1974 | Hannaman | 451/240 |
| 3,816,997 | 6/1974 | Rupp | 451/277 |
| 3,866,358 | 2/1975 | Rupp | 451/121 |
| 3,877,177 | 4/1975 | Taniguchi | 451/285 |
| 3,902,277 | 9/1975 | Rupp | 451/123 |
| 4,083,272 | 4/1978 | Miller | 82/12 |
| 4,680,998 | 7/1987 | Council, Jr. | 451/42 |
| 4,760,672 | 8/1988 | Darcangelo et al. | 451/42 |
| 4,807,398 | 2/1989 | Ramos et al. | 451/240 |
| 4,885,875 | 12/1989 | Soper | 451/43 |
| 4,947,715 | 8/1990 | Council, Jr. | 451/42 |
| 4,956,944 | 9/1990 | Ando et al. | 451/42 |
| 4,989,316 | 2/1991 | Logan et al. | 451/42 |
| 5,056,270 | 10/1991 | Curcher | 451/43 |
| 5,092,083 | 3/1992 | Raffaelli | 451/548 |
| 5,149,337 | 9/1992 | Watanabe | 451/42 |
| 5,410,843 | 5/1995 | Gottschald | 451/43 |

FOREIGN PATENT DOCUMENTS

| | | | |
|---|---|---|---|
| 245422 | 4/1912 | Germany | 451/544 |

*Primary Examiner*—James G. Smith
*Assistant Examiner*—Derris H. Banks
*Attorney, Agent, or Firm*—McCormick, Paulding & Huber

[57] ABSTRACT

A lens or lap blank surfacing machine, for use in making eyeglass lenses, and related surfacing method and rotary cutting tool, is one wherein the rotary cutting tool is moved point by point over the entire extent of a face of the blank to form a new face surface on the blank with the movements of the tool and blank relative to one another being controlled in three coordinate directions by a computer controller to give the formed surface a shape related to a given eyeglass prescription or similar specification. The rotary cutting tool has a number of peripheral zones surrounding its rotation axis with at least one of the zones having a fine cutting characteristic and with at least one other of the zones having a coarse cutting characteristic. In the movement of the tool and blank relative to one another, the tool is held so that its fine peripheral zone engages and cuts away blank material immediately adjacent the desired surface and so that the coarse peripheral zone engages and cuts away blank material to a depth not quite reaching the desired surface thereby leaving a thin layer of residual unwanted blank material which is cut away by the fine peripheral zone of the tool at a later time, this permitting the creation of a face surface of desired shape and fine surface finish.

2 Claims, 8 Drawing Sheets

OPTICAL LENS OR LAP BLANK SURFACING MACHINE, RELATED METHOD AND CUTTING TOOL FOR USE THEREWITH

FIELD OF THE INVENTION

This invention relates to a surfacing machine, and to a related method and cutting tool, for use in cutting optical lens or lap blanks to form face surfaces thereon; the face surface formed on a given lens blank being one which, after being brought to a polished state, in cooperation with the usually pre-formed face surface on the opposite side of the blank causes the blank to have refractive characteristics fulfilling an associated eyeglass prescription or similar specification; and the formed face surface in the case of a lap blank being of a reverse shape to the face surface formed on an associated lens blank so that the lap blank after surfacing can be used to fine and/or polish the related face surface of the associated lens blank; and deals more particularly with improvements in such machine, method and cutting tool permitting fast, accurate surfacing of lens or lap blanks with the face surfaces created having a fine surface finish allowing the surfaces to be easily brought to a polished state.

BACKGROUND OF THE INVENTION

In the making of eyeglass lenses, it is customary to provide lens blanks, sometimes made of glass but more usually made of a suitable plastic material. The lens blanks are typically circular in shape and have front and rear face surfaces, the front surface usually being convex and the rear surface usually being concave. The front surface is typically pre-formed and polished to a given shape and, in the case where the blank is to be used in the making of a multi-focal lens, includes a bifocal or trifocal segment.

In the making of a lens from a lens blank of the aforementioned type, it is known to machine the rear portion of the lens blank, using a so-called blank surfacing machine, to cut away material of the blank and to thereby leave behind a rear face surface in a raw or gray state and having such a shape that after uniform fining and polishing of that surface, the blank has the optical refractive qualities required to fill a given prescription, a lens thereafter being cut from the blank by an edging machine and put into an eyeglass frame. For the fining and/or polishing of the raw or gray surface formed on a lens blank by the surfacing machine, the same machine may be used to form a reversely shaped face surface on a plastic or metal lap blank with the lap so formed being used to fine and/or polish the lens blank surface in conjunction with known lap type fining and polishing machines.

A known machine for surfacing lens or lap blanks as described above is shown, for example, by U.S. Pat. No. 4,989,316. The machine of this patent uses a ball shaped rotary cutting tool. The blank to be surfaced is fixed to a holder and rotated about a first axis. As this rotation of the blank takes place, the tool is moved into cutting relation with the blank by movement along an axis intersecting and perpendicular to the first axis so that the tool moves along or traces a spiral path relative to the blank. The convolutions of the spiral path are relatively closely spaced to one another so that the tool essentially moves progressively over the entire rear portion of the blank cutting away the blank material and leaving behind a new rear face surface. The tool and blank are also moved relative to one another along the first axis as the tool traces the spiral path; and all of the motions are computer controlled so that the face surface formed can be given a spheric, toric or other shape customarily used for eyeglass purposes.

In the past, the face surfaces formed by lens or lap blank surfacing machines, unless very slow cutting procedures were used, tended to be of such surface quality as to require a significant amount of fining and/or polishing time and effort to bring the surface to a polished condition.

The general object of this invention is, therefore, to provide a lens or lap blank surfacing machine, a lens or lap blank surfacing method and a cutting tool whereby lens and lap blanks may be surfaced quite rapidly with the surface formed being of a fine finish capable of relatively easily being brought to a polished state with the shape given to the surface created by the surfacing machine being little changed, if at all, in the fining or polishing steps following the surfacing.

SUMMARY OF THE INVENTION

The invention resides in a surfacing machine for forming a face surface of fine finish and desired shape on a lens or lap blank, the machine including a holder for holding a blank, a rotary cutting tool, a tool drive for rotating the tool about its rotation axis and a cutting path drive mechanism for moving the holder and the tool relative to one another to cause the tool to trace a cutting path relative to the blank held by the holder so as to progressively cut away material from the blank and leave behind the desired face surface. The cutting tool used by the machine is one having a periphery surrounding its rotation axis with that periphery including a coarse peripheral zone and a fine peripheral zone located along different portions of the tool's rotation axis and with the zones having cutting elements of diverse character giving said coarse and fine zones coarse and fine cutting characteristics, respectively. As the machine moves the cutting tool along the cutting path, the tool is held so that its fine peripheral zone engages the blank and cuts away blank material immediately adjacent to the desired face surface and so that the coarse peripheral zone engages and cuts away blank material located a greater distance from the desired face surface than the material engaged and cut away by the fine peripheral zone.

The invention also more specifically resides in that the machine is one in which the rotary cutting tool is held with its rotation axis generally perpendicular to the face surface being formed, the tool having its fine peripheral zone located at the free end of the tool; or in that the machine is one in which the tool is held with its rotation axis generally parallel to the face surface being formed, the fine peripheral zone of the tool having a diameter essentially larger than the diameter of the coarse peripheral zone.

The invention also resides in a method for surfacing lens or lap blanks using a rotary cutting tool having coarse and fine peripheral zones surrounding its rotation axis and wherein the tool is moved along a cutting path relative to the blank being surfaced with its fine peripheral portion located adjacent the surface being formed so as to give that surface a fine finish and with its coarse peripheral zone being located further from that surface so as to more aggressively and speedily remove material from the blank.

The invention still further resides in a tool for use in the machine and method of the invention, the tool being a rotary one having coarse and fine peripheral zones arranged so that in the cutting of a blank, the fine peripheral zone may work on the blank closer to the surface being formed and so that the coarse zone can work on the blank at a greater distance from the surface being formed.

DETAILED DESCRIPTION OF THE PREFERRED EMBODIMENTS

Figure 1:
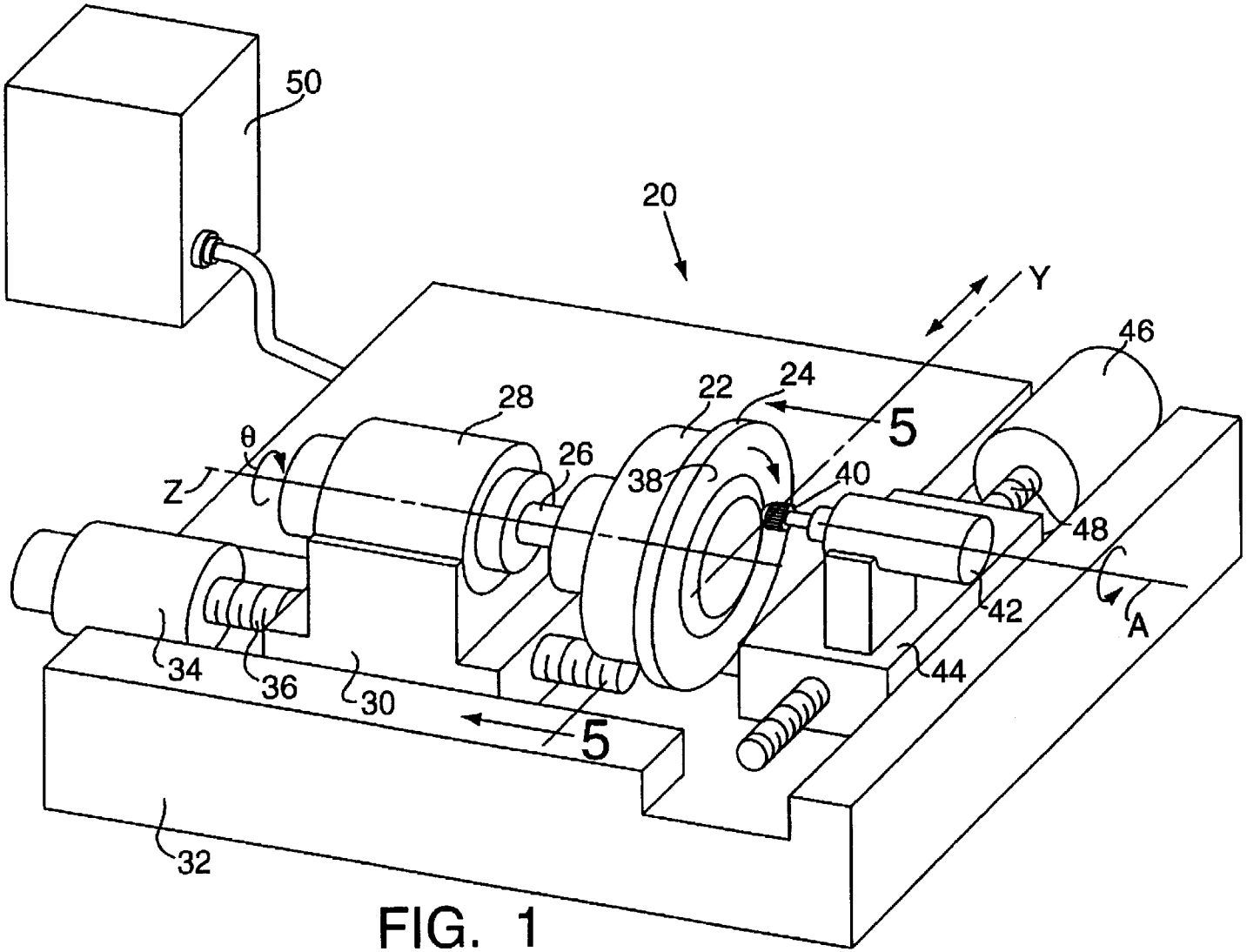
FIG. 1 is a schematic perspective view of a lens or lap blank surfacing machine embodying the invention.
Figure 2:
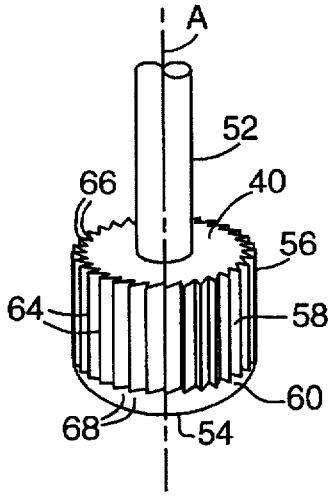
FIG. 2 is a perspective view of the rotary cutting tool used in the machine of FIG. 1.
Figure 3:
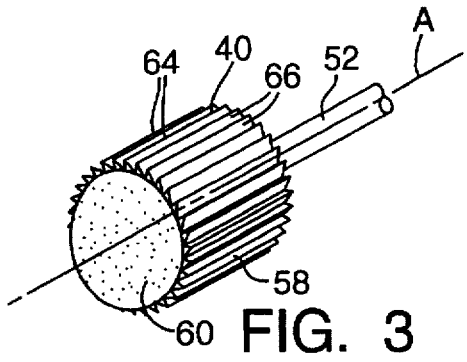
FIG. 3 is another perspective view of the rotary cutting tool of FIG. 2.

The machine and method of the invention are ones wherein a rotary cutting tool, itself forming another aspect of the invention, is moved relative to a lens or lap blank along a cutting path throughout a cutting operation such that in going from the start of the operation to the end of the operation, the tool is progressively moved point by point over the entire extent of the surface to be formed and at each point is positioned relative to the blank under control of a computerized controller, the control signals issued by the controller to the machine being related to a given eyeglass prescription so that the shape given the surface formed by the surfacing machine is one related to the prescription. Such a machine is shown, for example, by the above mentioned U.S. Pat. No. 4,989,316 wherein the cutting tool during the cutting process moves in a spiral path relative to the blank with the convolutions of the spiral being fairly closely spaced to one another.

In accordance with the invention, the rotary cutting tool used by the machine is one having peripheral cutting zones of diverse aggressiveness in respect to their cutting characteristics, at least one of the peripheral zones having cutting elements providing it with a coarse cutting characteristic and at least one other one of the zones having cutting elements providing it with a fine cutting characteristic; and the tool is so held during its movement along the cutting path that the fine peripheral zone of the tool engages and removes material from the blank immediately at the desired surface and so that the coarse peripheral zone engages and cuts away blank material at a distance from the desired surface. That is, the coarse zone engages and cuts away blank material rapidly and in relatively large pieces leaving behind a residual quantity of undesired blank material, of small height, between the surface it cuts and the desired surface, which quantity of residual material is subsequently engaged and cut away by the fine peripheral zone of the cutting tool leaving behind the desired surface and with that desired surface having a surface finish of good quality. In the positioning of the tool relative to the blank, the tool may be positioned with its rotation axis generally perpendicular to the desired surface being formed, in which case the coarse peripheral zone of the tool is essentially of larger diameter than the diameter of the fine peripheral zone; or the rotational axis of the tool may be positioned generally parallel to the desired surface being formed, in which case the coarse peripheral zone is basically of smaller diameter than the diameter of the fine peripheral zone.

In practicing the invention, the cutting tool of the blank surfacing machine has two or more peripheral zones with differing cutting characteristics and with differing diameters so that different peripheral zones of the tool cut into the blank to different depths, with the zone cutting to the deepest depth being one with a fine cutting characteristic so as to leave behind a final surface with good surface characteristics. As the coarser zone or zones remove material from the blank, some damage to the blank in the form of deep scratches may occur, and such cutting may also leave behind, due to stressing of the blank material, other damage in the form of changes in the crystalline structure of the blank material in a region of small depth adjacent to the surface or surfaces formed by the coarse cutting. Preferably, the zones of the cutting tool are so stepped, or of different diameters, that the damage caused by the cutting performed by one zone of the cutter is removed during the cutting performed by the next following peripheral zone. In any event, the tool is designed so that no peripheral zone of the tool damages the blank being cut to a depth deeper than the depth to which the final, or deepest cutting, peripheral zone cuts, with the final peripheral zone being a fine one removing only a small amount of blank material in its cutting and not stressing the blank sufficiently to cause any adverse change in the crystalline structure of the blank material. If the tool includes more than two peripheral cutting zones, the zones preceding the fine (and deepest cutting) zone may have similar cutting characteristics or may have cutting characteristics which become finer as their depths of cut increase.

FIGS. 1–5 show a surfacing machine, indicated generally at 20, wherein the rotary cutting tool is positioned with its rotation axis generally perpendicular to the surface formed during the surfacing operation on the associated blank.

As shown in FIG. 1, the machine 20 is similar to that of U.S. Pat. No. 4,989,316 and includes a holder 22 for holding a blank 24. The blank 24 may be either a lens blank or a lap blank, but for discussion purposes is hereinafter usually taken to be a lens blank. The holder 22 is supported for rotation in the theta (θ) direction about the illustrated Z axis by the shaft 26 of a motor 28 supported by a Z slide 30. The slide 30 is in turn supported on the base 32 of the machine for movement parallel to the Z axis and is drivingly positioned along the Z axis by a Z axis drive mechanism including a motor 34 fixed to the machine base 32, and a lead screw 36 driven by the motor 34 and threadably engaging the slide 30.

In FIG. 1 the surface being formed on the blank 24 is indicated at 38, and the rotary cutting tool is indicated at 40. The tool 40 is supported with its rotation axis A generally perpendicular to the surface 38 and so that at its point of engagement with the surface 38 it moves along a Y axis intersecting and perpendicular to the Z axis. The tool 40 is supported and driven about its rotation axis A by a drive motor 42 fixed to a Y slide 44 guided in the base 32 for movement parallel to the Y axis and driven in that movement by a Y motor 46 fixed to the base 32, and a lead screw 48 driven by the motor 46 and threadably engaging the slide 44.

In the process of surfacing the blank 24, the operation of the theta motor 28, of the Z motor 34 and of the Y motor 46 are simultaneously coordinated by the associated computer controller 50 so that as the holder 22 and blank 24 are rotated in the theta (θ) direction about the Z axis the tool 40 is moved along the Y axis, starting from the outer circumference of the blank and moving toward the Z axis, so that the tool moves along a spiral path centered on the axis Z relative to the blank and engages and cuts away material of the blank to form the desired surface 38. At the same time the holder 22 and blank 24 are moved relative to the tool 40 along the Z axis to vary the cutting depth of the tool in the Z direction, thereby permitting the surface 38 to be given a non-planar shape. For example, in the case of the blank 24 being a lens blank, the surface 38 may be concave with a spherical or toric contour and in the case of the blank 24 being a lap blank the surface 38 may be convex with a spherical or toric contour.

Figure 4:
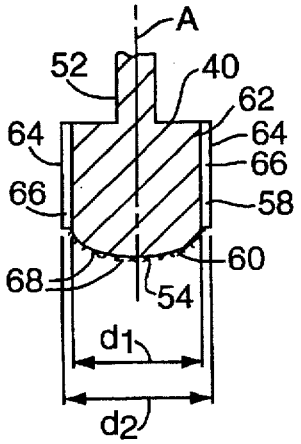
FIG. 4 is a sectional view of the rotary cutting tool of FIG. 2 taken on a plane containing the tool's rotation axis.

Referring to FIGS. 2–5, the cutting tool 40 has a shank end in the form of a shaft portion 52, adapted to be grasped and held by the drive motor 42, and a free end 54. The tool is symmetrical about the rotation axis A and in the region between the free end 54 and the shaft portion 52 has a periphery 56 surrounding the rotation axis A with that periphery including a coarse peripheral zone 58 and a fine peripheral zone 60 extending along different portions of the rotation axis A. The fine peripheral zone 60 is located adjacent the free end 54 of the tool and the coarse peripheral portion 58 is located between the fine peripheral portion 60 and the shaft portion 52. The two peripheral zones 58 and 60 have cutting elements with the cutting elements of the coarse zone giving that zone a coarse cutting characteristic and with the cutting elements of the fine zone giving that zone a fine cutting characteristic. The shapes of the peripheral zones may vary in keeping with the invention but the fine peripheral zone 60 has a maximum diameter which is no greater than the minimum diameter of the coarse peripheral zone. In the case of the illustrated tool 40, the coarse peripheral zone 58 is of a uniform diameter $d_2$ and the fine peripheral zone 60 has a generally convex shape, as seen in FIG. 4, with a maximum diameter $d_1$ less than the diameter $d_2$ of the coarse peripheral zone.

The cutting elements of the coarse and fine peripheral zones may be provided and formed in various different ways without departing from the invention. By way of example, in the cutting tool 40 the tool is comprised of a body 62, of metal, such as tungsten carbide or tool steel, or possibly of plastic or ceramic material, and the cutting elements of the coarse peripheral portion 58 are a plurality of axially extending sharp edges 64 provided by a plurality of integral blades 66. The cutting elements of the fine peripheral zone 60 are in turn a large number of finely sized abrasive particles 68 distributed over and fixed relative to the surface of the body 62 in the fine peripheral zone 60. The particles may be located only on or near the surface of the body and be suitably fixed to that surface by brazing, electroplating or other bonding method, or they may be dispersed throughout the material of the body. Various different hard materials may be used for the abrasive particles 68, but preferably they are made of either diamond or cubic boron nitride (CBN).

Figure 5:
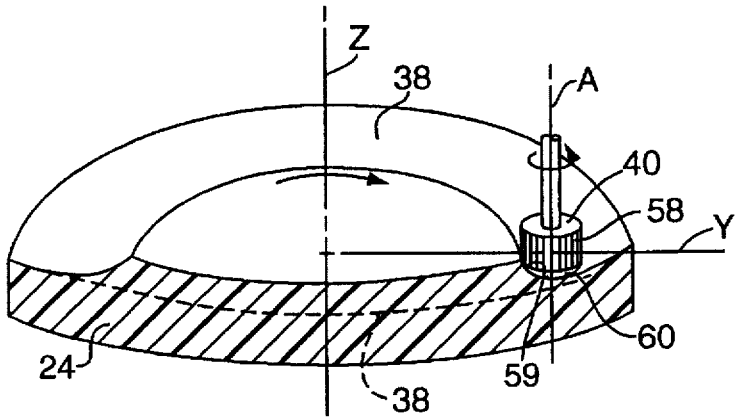
FIG. 5 is a partially sectional and partially perspective view of the blank and tool of FIG. 1 with the sectional portion of the view being taken on the line 5—5 of FIG. 1.

FIG. 5 shows the blank 24 and the tool 40 of FIG. 1 at an intermediate point in the surfacing process whereat the desired surface 38 has already been partially formed as a result of the tool 40 having moved through a number of convolutions of its spiral path relative to the blank 24 as a result of the blank 24 having been rotated about the Z axis while the tool 40 is moved inwardly along the Y axis toward the Z axis. From this figure it will be noted that the fine peripheral zone 60 of the tool engages the blank 24 immediately adjacent the desired surface 38 and that the coarse peripheral zone 58 engages the blank 24 at points spaced somewhat from the surface 38 in the direction of the Z axis, with those points also being spaced further from the axis A of tool rotation, than the points engaged by the fine peripheral zone 60, in the in-feed direction of movement of the tool 40 along the Y axis—that is toward the left in FIG. 5. The fine peripheral portion 60 of the tool therefore leaves a fine finish on the surface 38 while the coarse peripheral portion 58 cuts away large pieces of the blank material and leaves a thin residual layer or quantity 59 of unwanted blank material above the desired surface 38, which small residual quantity or layer of material is removed by the fine peripheral portion 60 after the blank 24 has moved through another one or more revolutions about the Z axis and the tool moved a slight distance to the left along the Y axis. In other words, during each convolution of the spiral movement of the tool relative to the blank, the coarse peripheral portion cuts away blank material efficiently and in relatively large pieces and leaves behind a thin layer of unwanted blank material above the desired surface 38 which thin layer of blank material is subsequently removed by the fine peripheral zone 60 during the next one or more convolutions of the workpiece relative to the tool.

Figure 6:
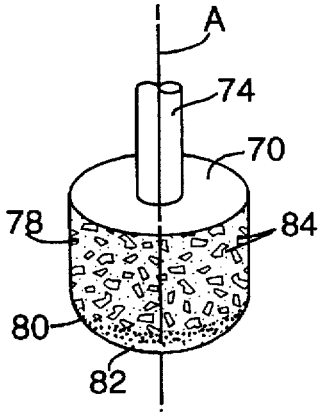
FIG. 6 is a perspective view of an alternative cutting tool for use with the machine of FIG. 1.
Figure 7:
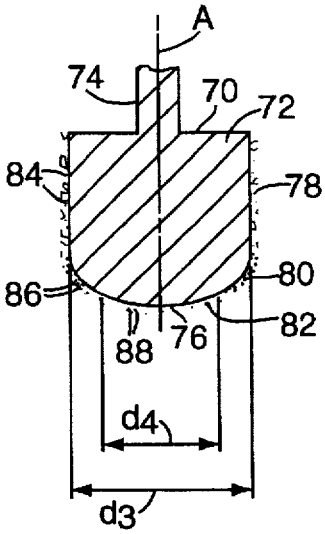
FIG. 7 is a sectional view taken through the tool of FIG. 6 with the view being taken on a plane containing the tool's rotation axis.

From the foregoing it is clear that the cutting tool used with the machine 20 may take on various different shapes and may be made of various different materials. The tool may have more than two peripheral zones with differing cutting characteristics and differing diameters, and the cutting elements of the different peripheral zones may be of various different types and various different materials. As an example of this, FIGS. 6 and 7 show another rotary cutting tool 70 which may be substituted for the tool 40. The tool 70 has a body 72 of metal with a shank or shaft portion 74 at one end and a free end 76 opposite the shank end. The tool has three peripheral zones surrounding the rotation axis A; namely a coarse zone 78, an intermediate zone 80 and a fine zone 82. The coarse zone 78 has a constant diameter $d_3$, the intermediate zone 80 has a maximum diameter equal to the diameter $d_3$ of the coarse zone and a minimum diameter $d_4$, and the fine zone 82 has a maximum diameter equal to the minimum diameter $d_4$ of the intermediate zone, the intermediate and fine zones 80 and 82 being curved and together forming a convex surface. The cutting elements of the coarse zone 78 are coarse particles 84 of diamond or cubic boron nitride (CBN) suitably carried by the body 72, the cutting elements of the intermediate zone are intermediate sized particles 86 of diamond or cubic boron nitride (CBN) carried by the body 72, and the cutting elements of the fine zone 82 are fine particles 88 carried by the body 72. Also, instead of the tool having the shape shown in FIGS. 6 and 7, it could be formed to have a ball shape—that is, with the coarse zone 78 being of parti-spherical shape rather than of cylindrical shape.

In the machine 20 of FIG. 1 the motor 42 is fixed to the slide 44 so that the rotation axis A of the tool 40 is maintained in fixed parallel or slightly inclined relation to the axis Z. In some instances, particularly in cases where the surface 38 being formed is steeply curved so as to have portions which are significantly inclined relative to the axis Z, it may be desirable to provide for movement of the tool rotation axis A about one or two axes passing through the point at which the fine peripheral zone of the tool engages the blank, so as to be able to maintain the rotation axis A perpendicular to, or more nearly perpendicular to, the portion of the desired surface 38 momentarily engaged by the fine peripheral zone of the tool.

Figure 8:
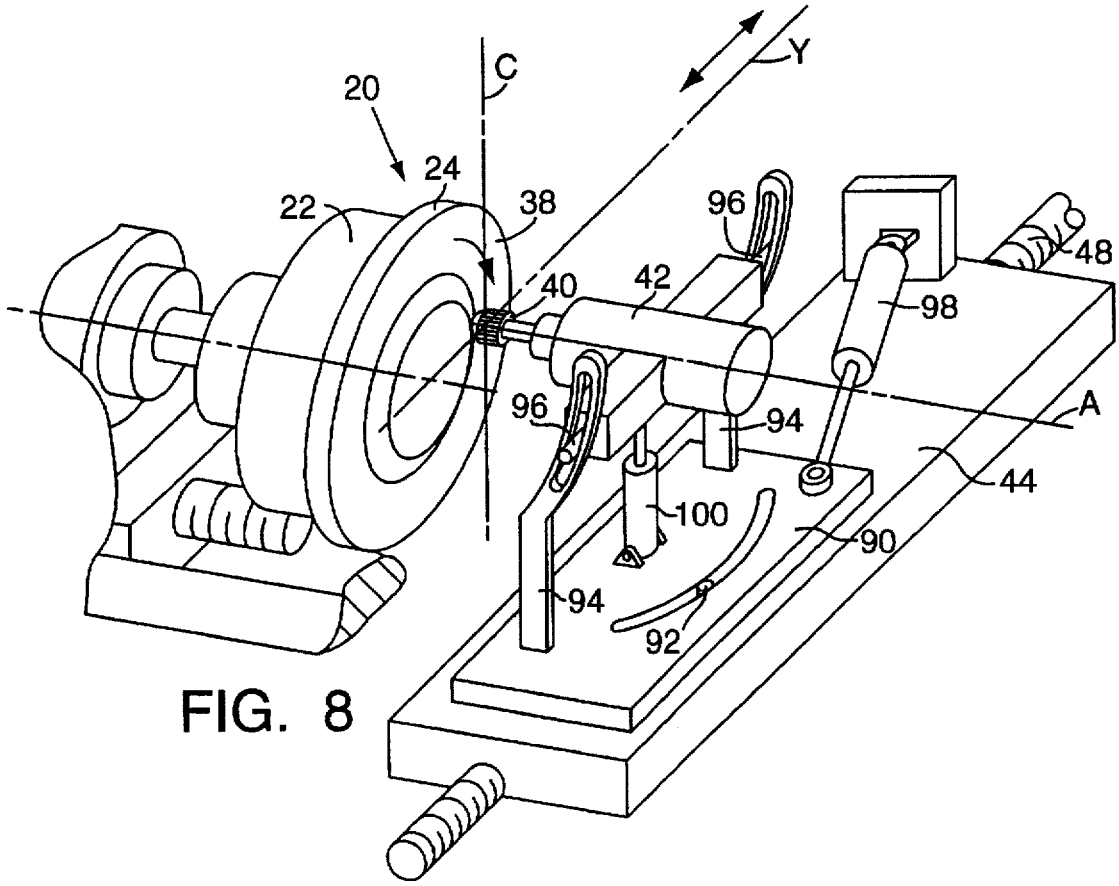
FIG. 8 is a fragmentary perspective view of a modified version of the machine of FIG. 1.

FIG. 8 shows a machine, indicated generally at 20' which is similar to the machine 20 of FIG. 1 except for having a modified support for the tool 40 to provide for positioning of the tool rotation axis A about two additional axes relative to the blank 24. As shown in FIG. 8, the tool 40 and its drive motor 42 are carried by the Y slide 44 through the intermediary of a support plate 90 supported on the slide by an arcuate slot and shoe connection 92 permitting the plate to move arcuately relative to the slide 44 about a vertical axis C intersecting the rotation axis A at the free end of the tool. The plate 90 further carries two upstanding supports 94 to which the drive motor 42 is connected by arcuate slot and shoe connections 96 permitting the rotational axis A to be moved about the horizontal Y axis intersecting the rotation axis A at the free end of the tool. Under control of the computer controller 50 the plate 90 is positioned about the C axis by means of an actuator 98, and the drive motor and tool 40 are moved relative to the upright supports 94 to rotate the rotation axis A about the Y axis by an actuator 100.

FIGS. 9–12 show another surfacing machine, indicated generally at 102, and related surfacing method and tool. The machine 102 is generally similar to the machine 20 of FIG. 1 except for the cutting tool being different from the tool 40 and having its rotation axis arranged generally parallel to the surface 38 formed on the blank 24. Parts of the machine 102 which are the same as those of the machine 20 have been given the same reference numerals as in the machine 20 and need not be further described.

In the machine 102 the cutting tool is indicated at 104 and is driven about a rotation axis B by a drive motor 105 mounted on the Y slide 44. During a cutting process the tool 104 is moved along the Y axis inwardly from the circumference of the blank 24 toward the Z axis while the blank 24 is rotated about the Z axis to cause the tool to trace a spiral path relative to the blank with the blank and tool being moved relative to one another along the z axis by the drive motor 34 at the same time and with the operations of the motors 28, 34 and 46 being controlled by the controller 50 to give the surface 38 the desired shape.

Figure 10:
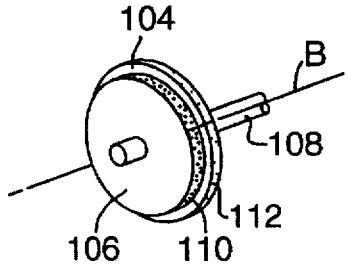
FIG. 10 is a perspective view of the rotary cutting tool used in the machine of FIG. 9.
Figure 11:
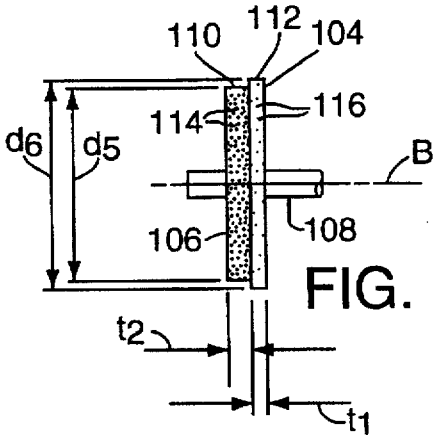
FIG. 11 is a side view of the tool of FIG. 10.

The tool 104 is shown in more detail in FIGS. 10 and 11 and includes a metal body 106 carried by a drive shaft 108 held by the drive motor 105. Surrounding the rotation axis B the body has two peripheral zones 110 and 112, the zone 110 having cutting elements in the form of coarse abrasive particles 114 of diamond, cubic boron nitride (CBN) or other hard material bonded to its outer surface and giving it a coarse cutting characteristic, and with the zone 112 having cutting elements in the form of fine abrasive particles 116 of diamond, cubic boron nitride (CBN) or other hard material bonded to its outer surface and giving the zone 112 a fine cutting characteristic. The two peripheral zones 110 and 112 are of right cylindrical shapes with the coarse peripheral zone 110 having a diameter $d_5$ slightly less than the diameter $d_6$ of the fine peripheral zone 112.

Figure 12:
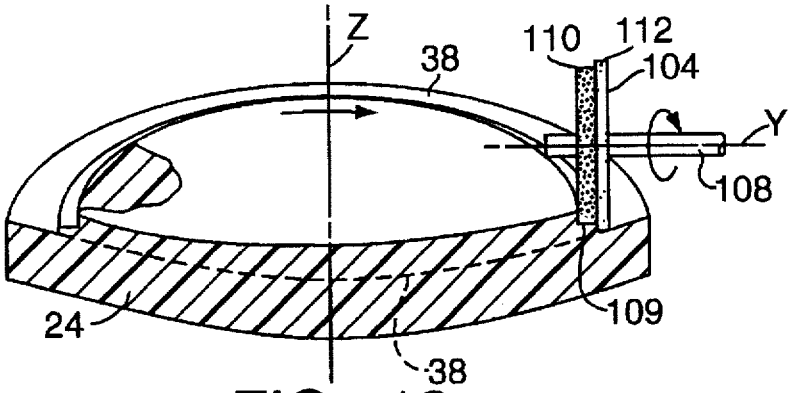
FIG. 12 is a partially sectional and partially perspective view of the blank and tool of FIG. 9 with the sectional portion of the view being taken on the line 12—12 of FIG. 9.

As shown in FIG. 12, as the tool traces a spiral path relative to the blank 24, as a result of the blank 24 being rotated about the axis Z while the tool is moved along the Y axis toward the Z axis, the fine peripheral zone 112 engages the blank 24 and cuts away blank material immediately adjacent the surface 38 being formed while the coarse peripheral zone 110 cuts away blank material to a point slightly above the surface 38 and on the advance side of the fine peripheral zone 112 with respect to the in-feed movement of the tool along the Y axis and toward the Z axis. Thus, as the tool moves along one convolution of the spiral path, the fine peripheral portion 112 cuts away a small amount of blank material and leaves behind a portion of the desired surface 34 with that portion having a good surface finish, while the coarse peripheral portion 110 more aggressively cuts away blank material from above the desired surface 38 and leaves behind a thin layer 109 of blank material immediately above the desired surface 38 which layer is cut away by the fine peripheral portion of the cutting tool during the next convolution of the spiral path.

Preferably, and as shown best in FIG. 11, the fine peripheral zone 112 has a thickness $t_1$ measured along the rotation axis B which is less than the thickness $t_2$ of the coarse peripheral portion 110 and which thickness $t_1$ is equal to or only slightly greater than the amount by which the tool 104 is moved along the Y axis for each convolution of the spiral path traced by the tool relative to the blank.

Figure 13:
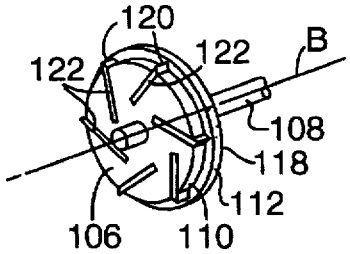
FIG. 13 is a perspective view of another rotary cutting tool for use with the machine of FIG. 9.

Of course, the shape and structure of the cutting tool used with the machine 102 may vary widely within the scope of the invention, and by way of an example, FIG. 13 shows another tool 118 which may be substituted for the tool 104 in the machine 102. In the tool 118 the fine peripheral zone 112 is similar to that of the tool 104, but the coarse peripheral zone 110 is one wherein the cutting elements are a plurality of sharp cutting edges 120 formed on blades 122 formed as individual elements and fixed to the body 106 of the tool. The blades 122 may be made of a hard metal such as tungsten carbide or tool steel, may be made of a composite material comprising abrasive particles, such as particles of diamond or cubic boron nitride (CBN), carried by a matrix material such as a plastic, metal or ceramic material, or may be made of polycrystalline diamond.

Figure 14:
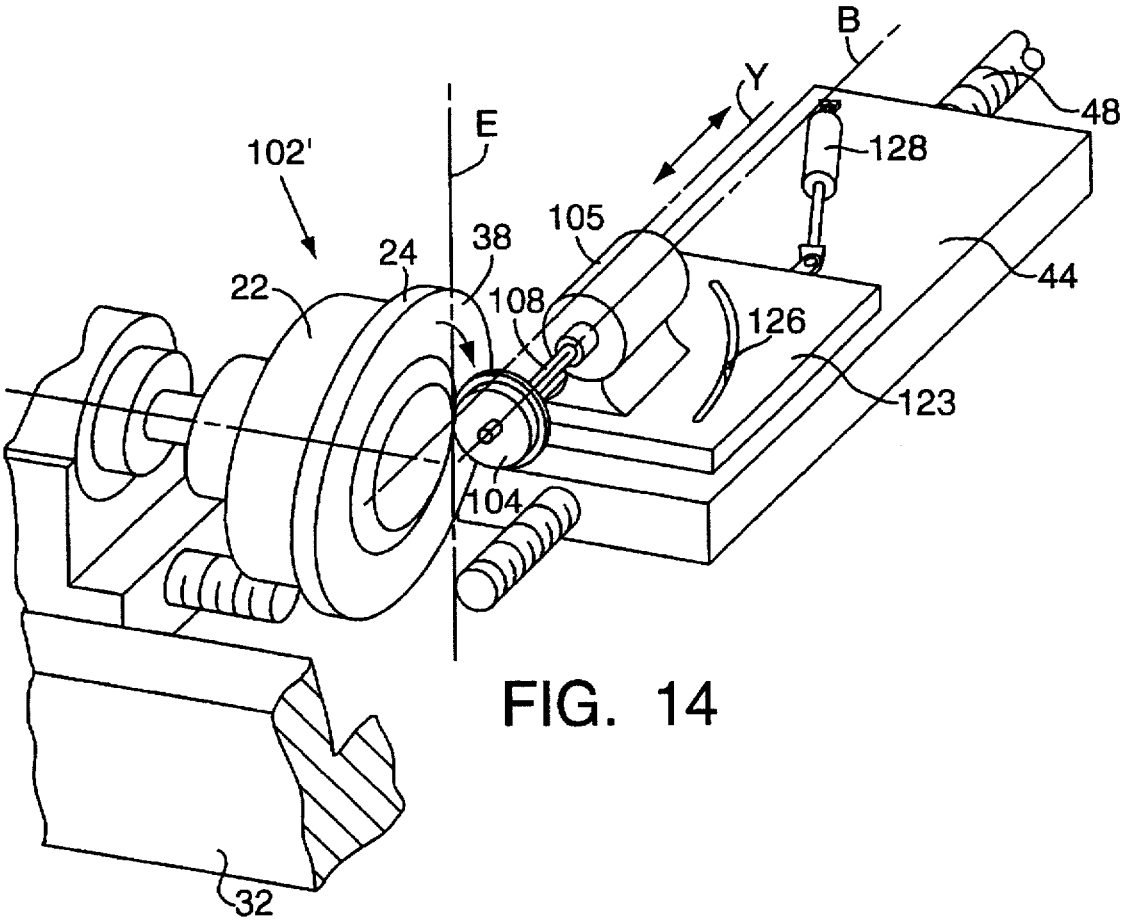
FIG. 14 is a fragmentary perspective view of a modified version of the machine of FIG. 9.

In the same way as discussed above for the machine 20, the machine 102 of FIG. 9 may be modified to permit movement of the tool rotation axis B about one or two axes passing through the point at which the fine peripheral zone of the tool engages the surface 38 being formed. Such a modified tool is shown in FIG. 14 and indicated at 102'. The machine 102' is similar to the machine 102 except for the tool drive motor 105 being mounted to the Y slide 44 through a plate 123 supported on the slide 44 through an arcuate slot and shoe connection 126 permitting the motor 105 and tool 104 to be rotated about a vertical axis E passing through the point at which the fine peripheral zone of the tool 104 engages the surface 38 being formed. An actuator 128 positions the plate 124 about the axis E and is controlled by the controller 50. In this way the tool 104 can be positioned so as to maintain the rotation axis B of the tool parallel, or more nearly parallel, to the portion of the surface 38 momentarily engaged by the fine peripheral portion of the tool despite changes in the inclination of the surface 38 with distance along the spiral cutting path of the tool relative to the blank.

Figure 9:
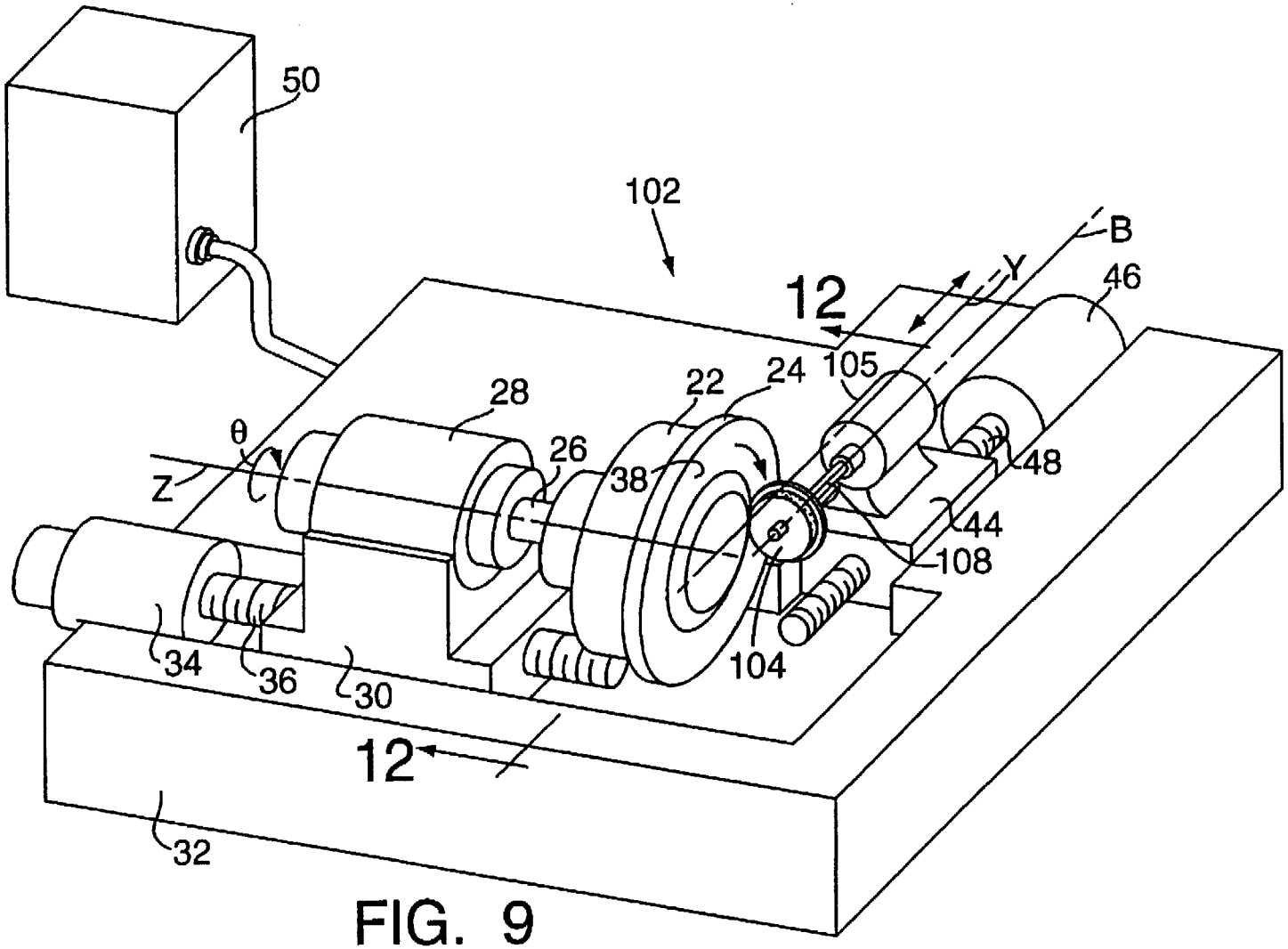
FIG. 9 is a schematic perspective view of a lens or lap blank surfacing machine comprising another embodiment of the invention.
Figure 15:
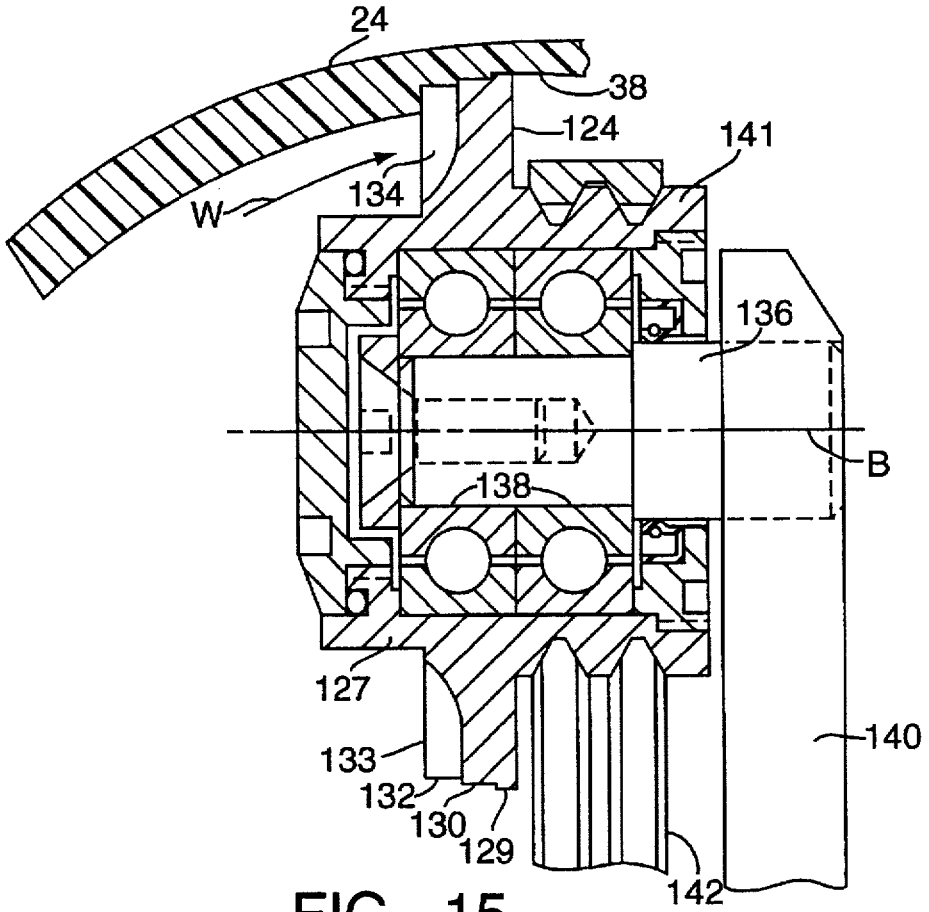
FIG. 15 is a sectional view illustrating another rotary cutting tool and associated support and drive which may be used with the machine of FIG. 9 or the machine of FIG. 14.
Figure 16:
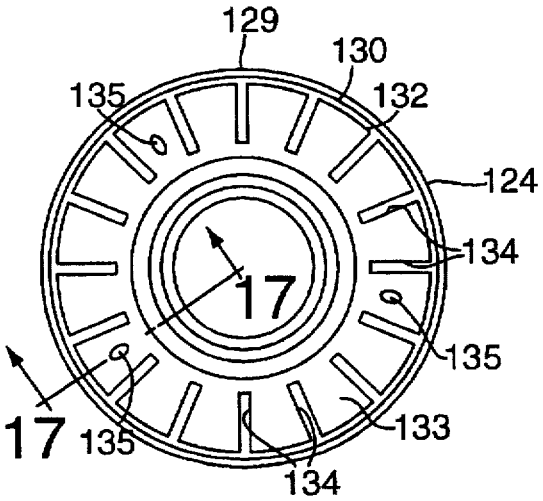
FIG. 16 is a front view, looking toward the right in FIG. 15, of the rotary cutting tool of FIG. 15

FIGS. 15 and 16 show another rotary cutting tool and associated support and drive which may be used in the machine 102 of FIG. 9 in place of the tool 104 and its particular support and drive. Referring to FIG. 15 the illustrated tool is indicated at 124. The tool 124 is comprised of a metal body 127 and has three peripheral zones 129, 130 and 132 of right cylindrical shape and a front face 133 on the free side of the coarse peripheral zone 132. The zone 129 is a fine zone having a fine cutting characteristic, the zone 130 is an intermediate zone having an intermediate cutting characteristic, and the zone 132 is a coarse zone having a coarse cutting characteristic. Of the three zones, the fine zone 129 has the largest diameter, the zone 132 has the smallest diameter and the zone 130 has an intermediate diameter. The body includes a plurality of radially extending relief grooves 134 communicating with the front face 133, and extending from a point radially inwardly of the coarse peripheral zone 132 to the coarse peripheral zone 132, to facilitate the escape of loose blank material cut from the blank 24 by the tool. The cutter is supported on a cylindrical post 136 for rotation about the rotation axis B by two ball bearing units 138, 138, with the post 136 being carried by a support arm 140 carried by the Y slide 44. The cutting tool 124 includes a hub portion 141 over which a drive belt 142 passes for rotating the tool, the belt 142 in turn being driven by a drive motor mounted on the Y slide 44.

Figure 17:
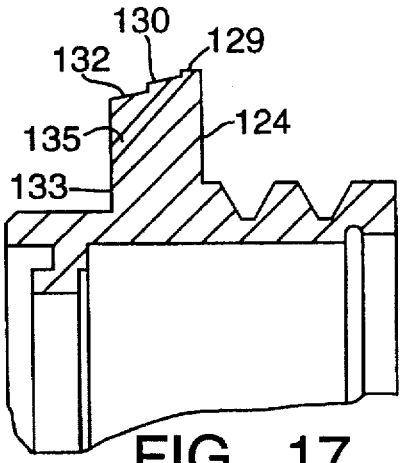
FIG. 17 is a fragmentary sectional view taken on the line 17—17 of FIG. 16.

In some instances it may be desirable to direct a stream of water or other liquid, as a coolant or flushing agent, onto the tool 124 generally in the direction of the arrow W of FIG. 15. When such a supply of liquid is used, the grooves 134 also serve to conduct the water radially outwardly relative to the tool to the interface between the tool and the blank 24. In addition to, or in place of the grooves 134, the tool 124 may also include a number of ducts, such as shown at 135 in FIGS. 16 and 17 extending in inclined fashion between the front face 133 of the tool, and the periphery of the tool. Water which is sprayed onto the face 133 will, therefore, enter the ducts 135 and upon being received in a duct is, by centrifugal force, pumped outwardly to the periphery of the tool and into the interface between the tool and the blank.

Figure 18:
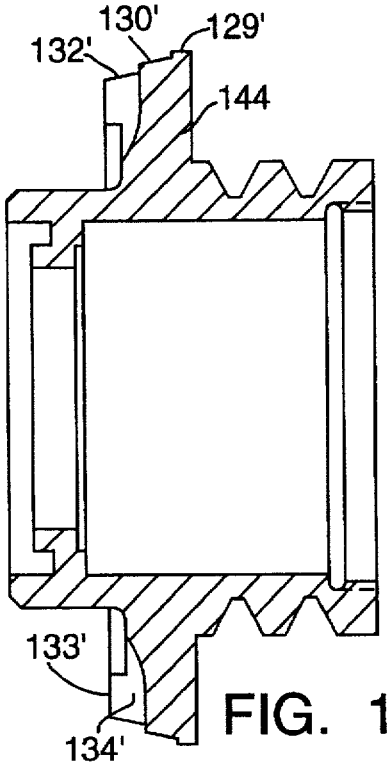
FIG. 18 is a cross-sectional view of another rotary cutting tool which may be used in place of the one shown in FIG. 15.

FIG. 18 shows another rotary cutting tool 144 which may be substituted for the tool 124 of FIG. 14. The tool 144 is similar to the tool 124 except for its peripheral zones 130' and 132' being of frusto-conical shape rather than right cylindrical shape.

In FIGS. 9 and 14, the two machines 102 and 102' are ones wherein the rotational axis B, or drive shaft 108, of the tool 104 is positioned so as to be generally perpendicular to the cutting path of the tool relative to the blank. Such positioning is not, however, essential to the broader aspects of the invention and, if desired, the tool rotational axis may also be arranged so as to lie parallel to the cutting path. Such a machine is shown at 102" in FIG. 19. Parts of this machine which are similar to those of the machine 102 of FIG. 9 have been given the same reference numerals as in FIG. 9 and need not be re-described.

Figure 19:
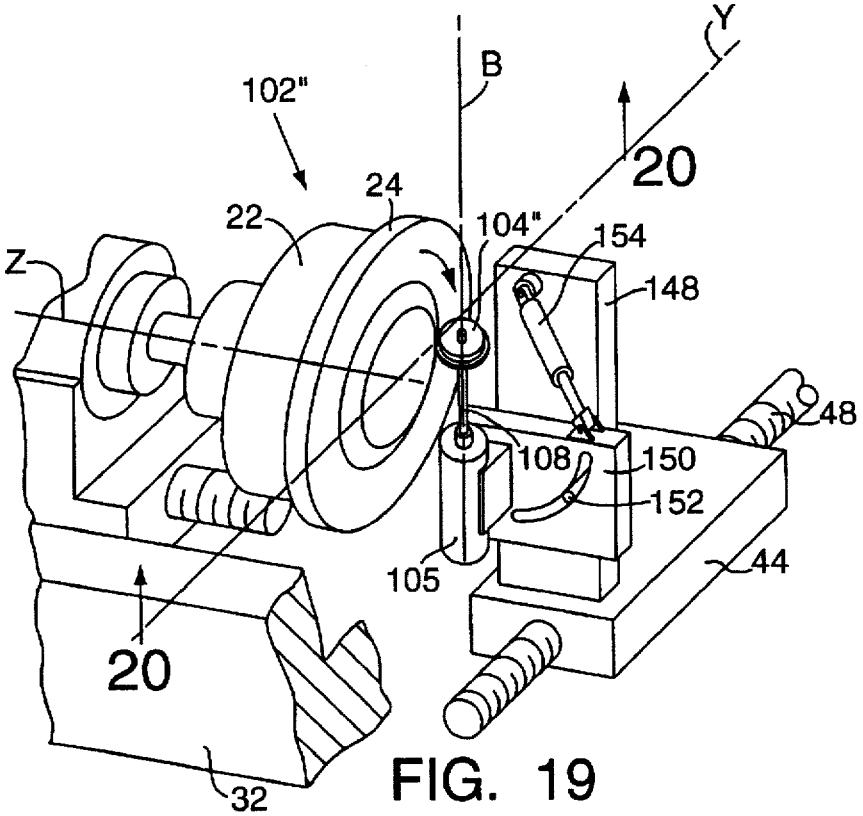
FIG. 19 is a fragmentary perspective view of a modified version of the machine of FIG. 9.

In the case of the machine 102" of FIG. 19, the tool drive motor 105 is carried by the Y slide 44 through an upright post 148, fixed to the slide 44, and by a plate 150 carried by the post 148 through an arcuate shoe connection 152 permitting the plate 150, the motor 105 and the tool 104" to be moved about an axis parallel to the Y axis and passing through the point at which the tool 104" engages the desired surface 38 formed by the tool on the blank 24, the motor 105 being mounted onto the plate 150 and the plate being movable relative to the post 148 about the aforesaid axis by an actuator 154 connected between the post 148 and plate 150 and working under the control of the controller 50.

Figure 20:
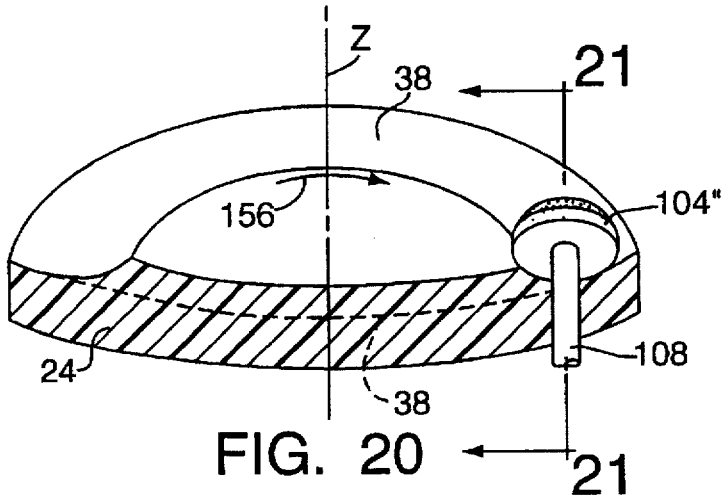
FIG. 20 is a partially sectional and partially perspective view of the blank and tool of FIG. 19 with the sectional portion of the view being taken on the line 20—20 of FIG. 19.
Figure 21:
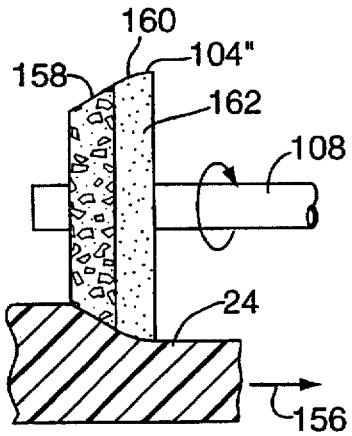
FIG. 21 is a partially sectional view of the blank and a side elevational view of the tool of FIG. 20 with the sectional portion of the view being taken on the line 21—21 of FIG. 20.

The positioning of the tool relative to the blank in the manner shown in FIG. 19 means that during a single revolution of the blank 24 about the Z axis the coarse and fine peripheral zones of the cutting tool cut the blank along the same convolution—that is, with respect to the relative motion between the blank and the tool along the spiral cutting path, the forwardmost peripheral zone cuts the blank substantially head on and the portion of the blank cut by the forwardmost peripheral zone is immediately further cut, during the same revolution of the blank, by the following peripheral zone or zones of the tool. This is illustrated in FIGS. 20 and 21, wherein the arrow 156 indicates the relative motion between the blank 24 and the tool 104" along the cutting path. As seen in FIG. 21, the tool 104" has a coarse peripheral zone 158, which is of a frusto-conical shape so as to be able to cut the blank 24 head on, and a following fine peripheral zone 160 which is shaped so as to blend from the maximum diameter of the coarse peripheral zone 158 to a generally right cylindrical rearward portion 162. Of course, it will be evident to one skilled in the art that many other different shapes and constructions of a tool for use with the machine 102" may be used without departing from the invention, with such tools possibly having three or more different peripheral zones in contrast to the two zones shown in FIG. 21.

Also, in the preceding description the tools used with the various illustrated and described surfacing machines have been taken to be ones of generally unitary or non-disassemblable construction. However, if desired, tools may be used wherein the different peripheral zones of the tool are carried by elements separate from one another and which elements may be assembled onto an arbor or the like to permit them to be added to or removed from the arbor at will to replace them when dull or to change the configuration of the tool. By way of example, such a tool is shown at 164 in FIGS. 22 and 23 in which case the shaft 166 of the tool is in the form of an arbor adapted to receive and non-rotatably hold a number of disc-like elements 168, 170 and 172 which can be placed onto the arbor in the fashion shown in FIG. 22 and releasably held to it by a nut 174. Each of the disc elements 168, 170 and 172 has a peripheral zone provided with abrasive particles giving it a distinct cutting characteristic, the element 168 having a peripheral surface 176 with fine abrasive particles giving it a fine cutting characteristic, the element 170 having a peripheral surface 178 with abrasive particles of intermediate size giving it an intermediate cutting characteristic, and the element 172 having a peripheral surface 180 with coarse abrasive particles giving it a coarse cutting characteristic.

Figure 22:
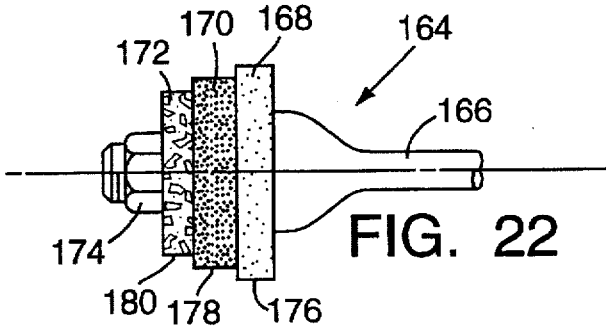
FIG. 22 is a side elevational view of a modified version of the tool usable with the machine of FIG. 9.
Figure 23:
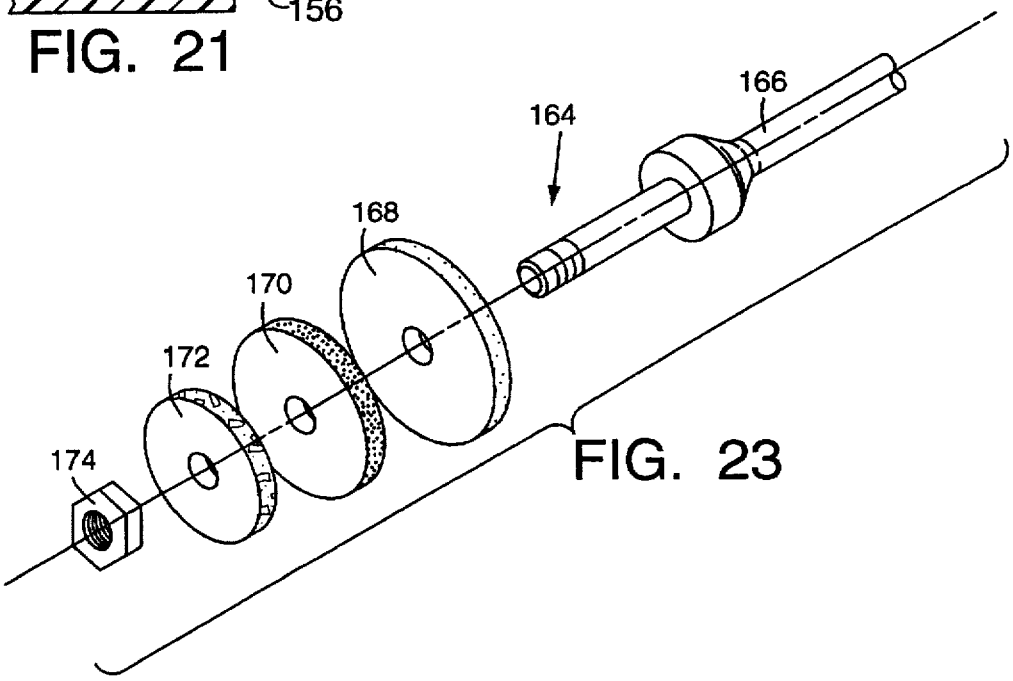
FIG. 23 is an exploded perspective view of the tool of FIG. 22.

It will be understood, however, that the tool 164 shown in FIGS. 22 and 23 is exemplary only and, using the same concept of replaceable cutting elements, many other tools may be formed using a different number of elements or elements of shapes and constructions different from those shown. Also, if desired, spacers or washers may be inserted between one or more adjacent pairs of the cutting elements.

We claim:

1. A rotary cutting tool for use in cutting a lens or lap blank to produce on the blank a face surface of fine finish and desired shape, said tool having a rotational axis and comprising:

means providing said tool with a periphery surrounding said rotational axis, said periphery including at least a coarse zone and fine zone which coarse and fine are located along different portions of said rotation axis, said coarse peripheral zone of said cutting tool having cutting elements giving said coarse peripheral zone a coarse cutting characteristic, said fine peripheral zone of said cutting tool having cutting elements giving said fine peripheral zone a fine cutting characteristic, said coarse peripheral zone having a maximum diameter, said fine peripheral zone having a minimum diameter no less than said maximum diameter of said coarse peripheral zone, said peripheral zones being defined by a body having a face to one side of said coarse peripheral zone, and said body having a plurality of grooves formed therein communicating with said face and each extending radially of said body from a point spaced radially inwardly of said coarse peripheral zone to said coarse peripheral zone.

2. A rotary cutting tool for use in cutting a lens or lap blank to produce on the blank a face surface of fine finish and desired shade, said tool having a rotational axis and comprising:

means providing said tool with a periphery surrounding said rotational axis, said periphery including at least a coarse zone and a fine zone which coarse and fine zones are located along different portions of said rotation axis, said coarse peripheral zone of said cutting tool having cutting elements giving said coarse peripheral zone a coarse cutting characteristic, said fine peripheral zone of said cutting tool having cutting elements giving said fine peripheral zone a fine cutting characteristic, said coarse peripheral zone having a maximum diameter, said fine peripheral zone having a minimum diameter no less than said maximum diameter of said coarse peripheral zone, said peripheral zones being defined by a body having a face to one side of said coarse peripheral zone and onto which face liquid may be sprayed, and said body including a plurality of ducts extending through said body from said face to at least one of said peripheral zones so as to be capable of picking up liquid sprayed onto said face and conveying the picked up liquid to said at least one peripheral zone.

* * * * *